US008621904B2

(12) United States Patent
Mizumura et al.

(10) Patent No.: US 8,621,904 B2
(45) Date of Patent: Jan. 7, 2014

(54) HYDROFORMING APPARATUS AND METHOD FOR HYDROFORMING

(75) Inventors: Masaaki Mizumura, Tokyo (JP); Koichi Sato, Tokyo (JP); Manabu Wada, Tokyo (JP); Yukihisa Kuriyama, Tokyo (JP)

(73) Assignees: Nippon Steel, Tokyo (JP); Sumitomo Metal Corporation, Tokyo (JP)

( * ) Notice: Subject to any disclaimer, the term of this patent is extended or adjusted under 35 U.S.C. 154(b) by 450 days.

(21) Appl. No.: 12/737,320

(22) PCT Filed: Jun. 30, 2009

(86) PCT No.: PCT/JP2009/062246

§ 371 (c)(1),
(2), (4) Date: Dec. 29, 2010

(87) PCT Pub. No.: WO2010/002017

PCT Pub. Date: Jan. 7, 2010

(65) Prior Publication Data

US 2011/0120203 A1 May 26, 2011

(30) Foreign Application Priority Data

Jul. 4, 2008 (JP) ..... 2008-175760

(51) Int. Cl.
*B21D 26/02* (2011.01)
*B21J 5/04* (2006.01)

(52) U.S. Cl.
USPC ..... 72/61; 72/16.1; 72/18.1; 72/58

(58) Field of Classification Search
USPC ..... 72/16.1, 17.3, 18.1, 18.6, 54, 57, 58, 72/60, 61; 700/197; 29/421.1
See application file for complete search history.

(56) References Cited

U.S. PATENT DOCUMENTS

| | | | | |
|---|---|---|---|---|
| 6,128,936 | A * | 10/2000 | Yogo | 72/58 |
| 7,191,032 | B2 * | 3/2007 | MacEwen et al. | 72/58 |
| 2006/0107716 | A1 * | 5/2006 | Dykstra et al. | 72/60 |

FOREIGN PATENT DOCUMENTS

| | | |
|---|---|---|
| JP | 09-314244 | 12/1997 |
| JP | 2003-039121 | 2/2003 |

(Continued)

OTHER PUBLICATIONS

"Effect of loading path on formation limit of hydroforming of rectangular section," Proceedings of the 2000 Japanese Spring Conference for the Technology of Plasticity, p. 433-434 (May 26, 2000).

(Continued)

*Primary Examiner* — Teresa M Ekiert
(74) *Attorney, Agent, or Firm* — Kenyon & Kenyon LLP

(57) ABSTRACT

A hydroforming apparatus and working method able to simply find a load path are proposed, which system and method use a mold in which contact sensors able to judge contact with a metal tube inside the mold are mounted at least at two different positions in the tube axial direction, perform a first step of axially pushing tube ends in a state with the internal pressure held at a constant value and stopping the progress of the axial pushing action when judging that among the contact sensors not yet in contact mounted at positions closest to the tube ends detect contact with the metal tube, next perform a second step of raising only the internal pressure while leaving the positions of the tube ends fixed and stopping the increase in the internal pressure when the contact sensor not yet in contact judges contact, next perform a third step of lowering the internal pressure to the value before raising it while leaving the positions of the tube ends fixed, and repeat said first step to third step until all of said contact sensors judge contact so as to obtain a hydroformed part.

5 Claims, 6 Drawing Sheets

(56) References Cited

FOREIGN PATENT DOCUMENTS

| | | |
|---|---|---|
| JP | 2003-311343 | 11/2003 |
| JP | 2004-351478 | 12/2004 |
| JP | 2004-230433 | 8/2007 |
| JP | 2007-275972 | 10/2007 |

OTHER PUBLICATIONS

International Search Report dated Aug. 25, 2009 issued in corresponding PCT Application No. PCT/JP2009/062246.

* cited by examiner

HYDROFORMING APPARATUS AND METHOD FOR HYDROFORMING

This application is a national stage application of International Application No. PCT/JP2009/062246, filed 30 Jun. 2009, which claims priority to Japanese Application No. 2008-175760, filed 4 Jul. 2008, which is incorporated by reference in its entirety.

TECHNICAL FIELD

The present invention relates to a hydroforming apparatus placing a metal tube in a mold, clamping the mold, then applying internal pressure in the tube and a pushing action in the tube axial direction (hereinafter referred to as an "axial pushing action") to form the tube into a predetermined shape and a method for hydroforming using this system for working a material.

BACKGROUND ART

In recent years, applications for hydroforming have been growing—particularly in the field of auto parts. The advantages of hydroforming are that it is possible to form an auto part, which used to be made from several press-formed parts, from a single metal tube, that is, combine parts and thereby reduce costs, and reduce the number of welding locations and thereby lighten the weight.

On the other hand, with hydroforming, it is necessary to control the two parameters of the internal pressure and axial pushing action so as to form the part. If the load path of these two parameters (hereinafter referred to as simply the "load path") is unsuitable, the metal tube may crack in the middle of being worked, buckling or wrinkles may end up remaining, and other working defects may be caused.

A general example of the load path is shown in FIG. 1. First, it is comprised of stage 1 of raising only the internal pressure (to seal the tube ends, sometimes a slight axial pushing action is also given), stage 2 of applying the internal pressure and an axial pushing action in a broken line pattern, and stage 3 of raising only the internal pressure for sharply forming the corners (with shapes with no corners, sometimes this is omitted, while to secure a seal of the tube ends, sometimes a slight axial pushing action is also given).

Among these, finding a suitable path for stage 2 consumes the most effort and has relied heavily on the skill of the hydroforming workers.

From the above background, recently several methods for simply obtaining the load path have been proposed.

For example, Patent Document 1 discloses the method of preparing in advance a crack limit line and a wrinkle limit line and selecting a load path between the two limit lines. However, in actuality, it is difficult to prepare these two limit lines. Usually, a large number of experiments and trial and error in analysis of numerical values are required. Further, the limit lines are often broken lines. If so, the number of parameters for determining the broken lines becomes greater and therefore tremendous labor becomes necessary for the trial and error.

Further, Patent Document 2 proposes a method of performing FEM analysis and monitoring the surface area, volume, or thickness of the metal tube to find the suitable load path. The information monitored here can be monitored by FEM analysis, but cannot be monitored during actual hydroforming.

As opposed to this, Patent Document 3 of the present inventors proposes a working method and working system embedding sensors for measuring the stress or strain in the actual hydroform mold and deriving the suitable load path from that information.

However, in the above prior arts, in each case, at stage 2 in the load path (FIG. 1), paths are employed raising the internal pressure as well along with the increase in axial pushing action. For this reason, at least two parameters, for example, the internal pressure and axial pushing amount or the axial pushing amount and inclination have to be determined. This becomes extremely complicated. Further, when stage 2 is a broken line, the parameters increase more, so finding a suitable load path becomes further difficult.

PRIOR ART DOCUMENTS

Patent Documents

Patent Document 1: Japanese Patent Publication (A) No. 2004-230433

Patent Document 2: Japanese Patent Publication (A) No. 2004-351478

Patent Document 3: Japanese Patent Publication (A) No. 2007-275972

Non-Patent Documents

Non-Patent Document 1: Proceedings of the 2000 Japanese Spring Conference for the Technology of Plasticity, (2000), p. 433

SUMMARY OF THE INVENTION

Problem to be Solved by the Invention

In the present invention, there are provided a hydroforming apparatus and method for hydroforming able to simply find a load path for hydroforming—which had required tremendous trial and error and skill in the past.

Means for Solving the Problem

To solve this problem, the present invention has as its gist the following.

(1) A hydroforming apparatus having a mold, axial pushing means, and internal pressure means and applying internal pressure to a metal tube set in the mold to form it into a predetermined shape, wherein, at the inside of said mold at locations not contacting said metal tube when said mold is set with said metal tube or said locations and locations no longer in contact along with progress of hydroforming, contact sensors able to judge contact with said metal tube are mounted at least at two different positions in the tube axial direction, the apparatus has control means for controlling the axial pushing action and internal pressure by judgment of contact of said mold and said metal tube obtained by said contact sensors, and said control means has the function of performing a first step of axially pushing tube ends in a state with the internal pressure held at a constant value and stopping the progress of the axial pushing action when judging that among the contact sensors not yet in contact with said metal tube, the contact sensors mounted at positions closest to the tube ends contact said metal tube, next performing a second step of raising only the internal pressure while leaving the positions of the tube ends fixed and stopping the increase in the internal pressure when judging contact by at least one of the sensors not yet in contact among said contact sensors, next performing a third step of lowering the internal pressure to the value before raising it while leaving the positions of the tube ends fixed, and repeating said first step to third step until all contact sensors judge contact.

(2) A hydroforming apparatus as set forth in (1) characterized in that said metal tube is bent in advance into a predetermined shape, said contact sensors are mounted at the inside of said mold at locations facing the inside position of the bend of said metal tube which contact said metal tube when said metal tube is set, lose contact with said metal tube once along with the progress of the hydroforming, and finally contact said metal tube again, and further said contact sensors are mounted at least at one different position inside said mold at locations facing the inside of the bend before and after said inside position of the bend of said metal tube in the axial direction which are not in contact with said metal tube when said metal tube is set.

(3) A method for hydroforming using a working apparatus having a mold, axial pushing means, and internal pressure means to apply internal pressure to a metal tube set in said mold so as to form it into a predetermined shape, said method characterized by attaching contact sensors able to judge contact with said metal tube inside said mold at locations not contacting said metal tube at the time when said metal tube is set or said locations and locations which lose contact with said metal tube along with progress of hydroforming at least at two different positions in the tube axial direction, performing a first step of axially pushing the tube ends in the state holding the internal pressure at a constant value and stopping the progress of the axial pushing action when contact sensors mounted at positions closest to the tube ends among said contact sensors not in contact with said metal tube judge contact with said metal tube, next performing a second step of raising only the internal pressure while leaving the positions of the tube ends fixed and stopping the rise of internal pressure when at least one of the sensors not in contact among said contact sensors judge contact, then performing a third step of lowering the internal pressure to the value before the rise while leaving the positions of the tube ends fixed, then, after this, repeating said first step to third step until all of said contact sensors judge contact.

(4) A method for hydroforming as set forth in (3) characterized in that said metal'tube is bent in advance into a predetermined shape, mounting said contact sensors at the inside of said mold at locations facing the inside position of the bend of said metal tube which contact said metal tube when said metal tube is set, lose contact with said metal tube once along with the progress of the hydroforming, and finally contact said metal tube again, and further mounting said contact sensors at least at one different position inside said mold at locations facing the inside of the bend before and after said inside position of the bend of said metal tube in the axial direction which are not in contact with said metal tube when said metal tube is set.

(5) A method for hydroforming as set forth in (3) or (4) characterized by judging full contact of said contact sensor, then further raising only the internal pressure.

Effects of the Invention

According to the present invention, finding a suitable load path of hydroforming becomes easy, application of hydroforming becomes easier, and application to parts for which hydroforming was difficult in the past becomes possible.

BEST MODE FOR CARRYING OUT THE INVENTION

Figure 1:
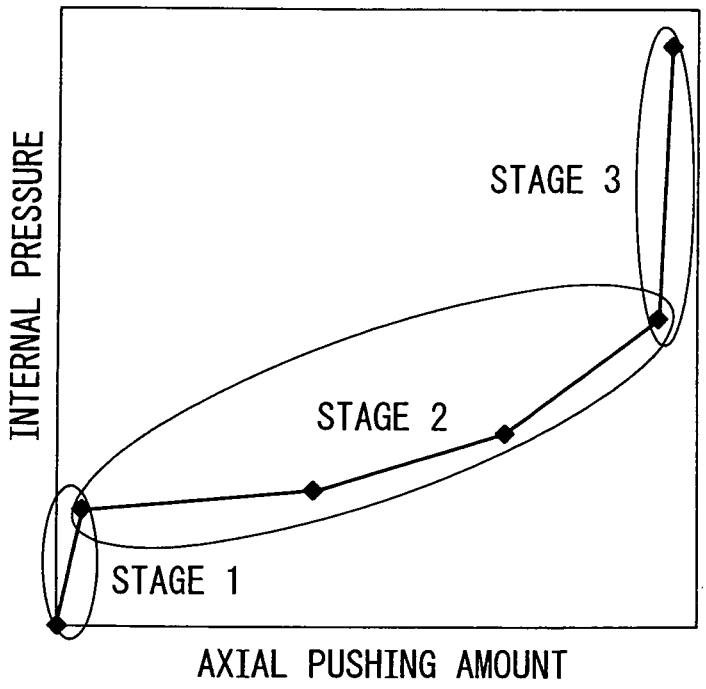
FIG. 1 is an explanatory view of a general load path of hydroforming.
Figure 2:
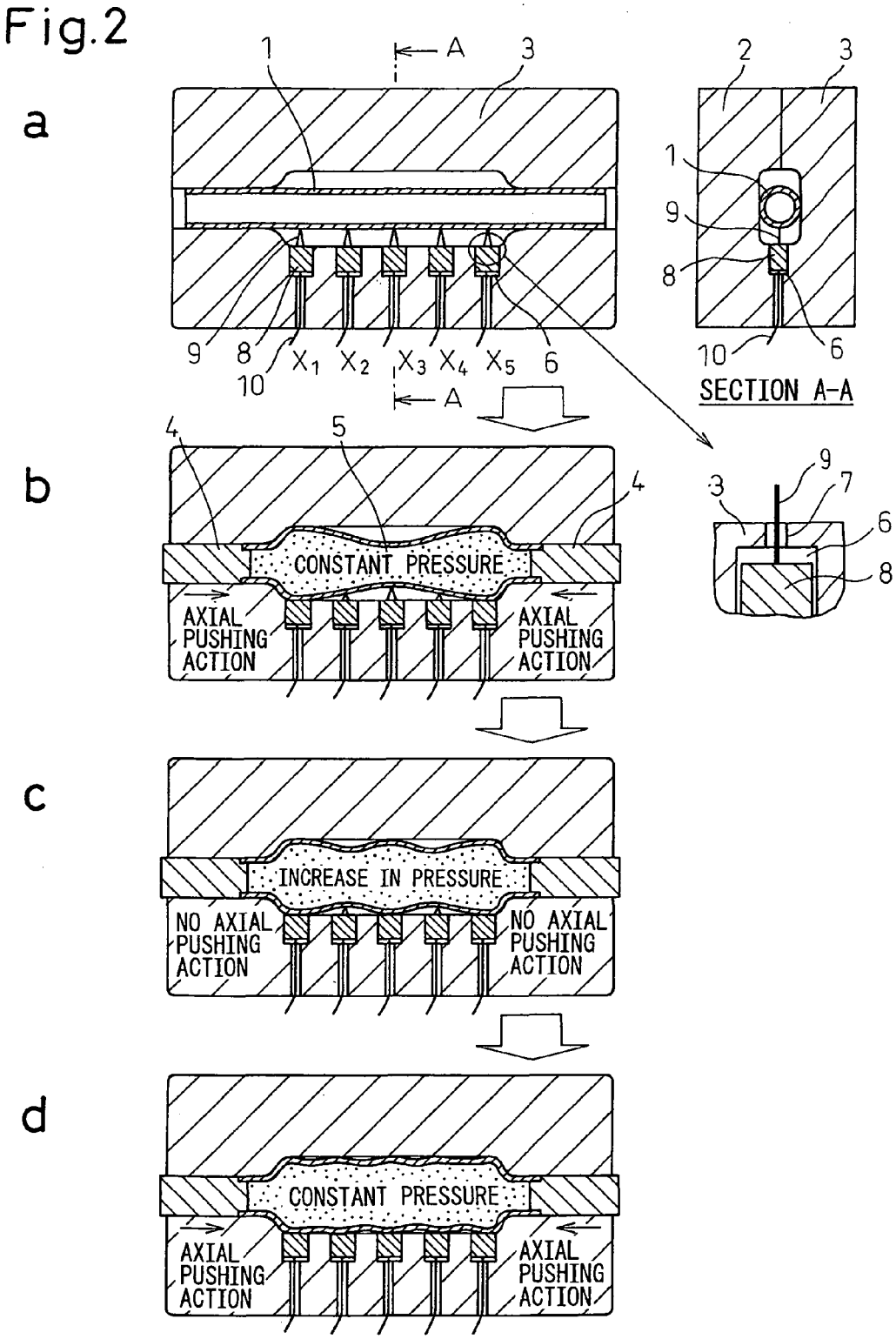
FIG. 2 is an explanatory view of a hydroforming apparatus of the present invention.

The present invention will be explained taking as an example hydroforming in the case of expanding a metal tube having a circular cross-section as shown in FIG. 2 into a rectangular cross-section.

The metal tube 1 to be hydroformed is set in molds 2 and 3 by which a working space of a rectangular cross-section is formed. In the initial state, the metal tube 1 and the mold surfaces of the molds 2 and 3 contact the short side directions of the rectangle, but do not contact the long side directions.

At positions at the center of the surface in the non-contact direction (in the case of the present example, exactly the mating part of the molds 2 and 3), the mold 2 and mold 3 are provided with holes 6 (in the present example, since exactly at the mold mating part, becoming grooves provided at the mating surfaces of the molds 2 and 3). The same is true for the later explained holes 7 as well).

In the holes 6, laser displacement meters 8 are mounted. At the locations where the holes 6 reach the surface of the inside of the mold, holes 7 through which lasers 9 pass are formed. The holes 7 are preferably extremely small from the viewpoint of hydroforming. By using the laser displacement meters 8 to measure the distance from the metal tube 1, it is possible to accurately judge contact of the molds 2 and 3 and the metal tube 1.

Among other sensors, quartz pressure sensors mounted at the inside of the mold (Patent Document 1) etc. can also detect contact with the metal tube, so are included in the contact sensors of the present invention.

After this, such laser displacement meters 8 and the holes 6 etc. mounting them will be referred to all together as "contact sensors" in some cases.

In this example, as contact sensors, laser displacement meters were set at five locations ($X_1$ to $X_5$) at different cross-sections in the tube axial direction.

Figure 3:
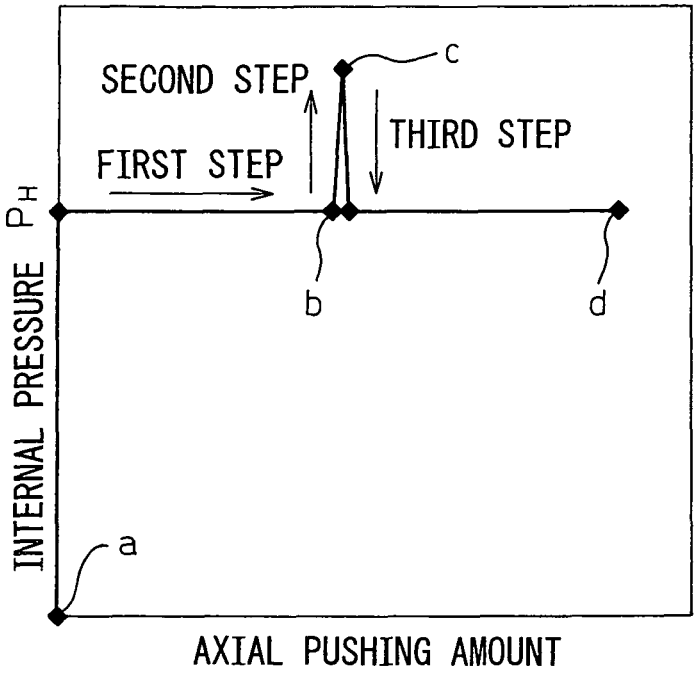
FIG. 3 is an explanatory view of a hydroforming apparatus of the present invention.

Next, the method of using the above contact sensors to find a suitable load path will be explained. Note that a schematic view of a suitable load path is shown in FIG. 3.

First, in the same way as the above method, without applying an axial pushing action, a fluid (for example, water) 5 is injected into the metal tube 1 to raise only the internal pressure. However, in some cases, to prevent seal leakage from the tube ends, sometimes a slight axial pushing action is applied.

This initial pressure $P_H$ is the pressure at which the metal tube plastically deforms without cracking and is found relatively easily by calculation or experiments.

For example, the present inventors engaged in research and as a result learned that the yield starting pressure $P_p$ in the planar strain state of the metal tube (see following formula (1)) can be used as a yardstick for the initial pressure $P_H$ (see Non-Patent Document 1).

Note that the "D" on the formula indicates the outside diameter of the stock tube (mm), "t" the wall thickness (mm), and "r" the r value, and "YS" and "$YS_p$" indicate the 0.2% yield strengths in the single-axis tension state and planar strain state.

$$P_p = 2YS_p \frac{t}{D-t},\ YS_p = \frac{1+r}{\sqrt{1+2r}} YS \tag{1}$$

However, when the shape is complicated etc., the error from the above formula becomes larger, so it is more reliable to find the initial pressure $P_H$ experimentally. Specifically, the initial pressure $P_H$ is set with reference to the pressure when cracking when raising the internal pressure until the metal tube cracks without applying an axial pushing action. For example, it is set to a pressure of 0.7 to 0.8 time the pressure at the time of cracking.

In the above way, the internal pressure is raised until the initial pressure $P_H$ found by calculation or experiment, but in this state, the metal tube 1 is not expanded much at all.

Next, the step where the internal pressure and axial pushing action are applied is entered, but with the method of the present invention, first, while holding the internal pressure at the initial pressure $P_H$, the axial pushing punch 4 is made to advance to apply only an axial pushing action.

As a result of research of the present inventors, even with a load of only an axial pushing action not raising the internal pressure, the metal tube is expanded, but in this case, not the center, but the end parts $X_1$ and $X_5$ are expanded the most.

Further, after the contact sensors at $X_1$ and $X_5$ detect contact, the axial pushing action is stopped (FIG. 2*b* and FIG. 3*b*). The process up to here is called the "first step".

After stopping the axial pushing action, only the internal pressure is raised. As a result of research of the inventors, when expanding the tube by only internal pressure without an axial pushing action, the tube is expanded from the center part rather than the end parts. In the case of the present example, $X_3$ is expanded the most.

Further, when the contact sensor at $X_3$ detects contact, it stops the increase in pressure (FIG. 2*c* and FIG. 3*c*). This step is called the "second step".

After this, while stopping the axial pushing action, the pressure is lowered once to the initial pressure $P_H$. This process is called the "third step". Even if applying an axial pushing action without lowering the internal pressure, the pressure is too high, so the metal tube immediately ends up cracking.

In the above way, after performing the first to third steps, the above steps are successively repeated from the above first step. The steps are ended when the contact sensors at all of the positions detect contact with the metal tube.

At this time, at the repeated first step, the progress of the axial pushing action is stopped when the contact sensors attached to the positions next closest to the tube ends detect contact of said metal tube.

In the case of the present example, at the time of finishing the processing steps up to here, $X_2$ and $X_4$ are not in contact. Therefore, at the repeated first step, the axial pushing action is applied again while maintaining the pressure $P_H$ and the axial pushing action is stopped after contact of $X_2$ and $X_4$ is detected.

In this case, the sensors at $X_2$ and $X_4$ are contact sensors mounted at said next closest positions, so as a result the time when $X_2$ and $X_4$ detect contact of the metal tube and the time when the contact sensors at all the positions detect contact match. For this reason, it is possible to end the steps at this point of time.

When, due to a long worked part or other reason, there is a contact sensor not in contact with the metal tube at this time, the second and third steps are executed. The first to third steps are similarly repeated until the contact sensors at all positions detect contact.

By the above hydroforming method, the tube is uniformly expanded without buckling or wrinkles remaining over its entire length.

With the method of simultaneously increasing the axial pushing action and internal pressure as in the conventional method, the end parts are preferentially expanded. For this reason, with a shape of a part long in the tube axial direction, sometimes the center part is not expanded and buckling or wrinkles remain.

As opposed to this, with the method of the present invention, the end parts and the center part are alternately expanded, so are resistant to buckling or wrinkles remaining. In this point, the method is extremely advantageous.

Furthermore, at both the first step and both the second step, the parameter changed is just either of the axial pushing action or internal pressure, so finding the suitable conditions is extremely simple. This can also be said to be a major advantage of the present invention.

In the above hydroforming method, the present invention according to (2) was explained, but when the final predetermined shape is not reached by the steps up to there, for example corner, when desiring to form the corners sharply, only internal pressure is applied up to a high pressure (the present invention according to (3)).

Further, the above working method may also be performed by manually controlling the increase and stopping of the internal pressure and the progress and stopping of the axial pushing action while viewing the results of detection of the contact sensors, but may also be performed by a hydroforming apparatus having a control means automatically detecting the results of detection of the sensors and automatically controlling the axial pushing action or internal pressure (the present invention according to the above (1)).

Further, in the present example, the explanation was given of employing laser displacement meters for the contact sensors, but similar effects are obtained even if using other methods. For example, it is also possible to utilize the phenomenon of the change in stress and strain of the mold when the metal tube contacts the mold and attach quartz pressure sensors and strain gauges inside the mold. Further, contact type displacement meters etc. are also not a problem.

The contact sensors are attached at positions where the mold and metal tube basically do not contact each other when the mold is set with the metal tube.

Figure 4:
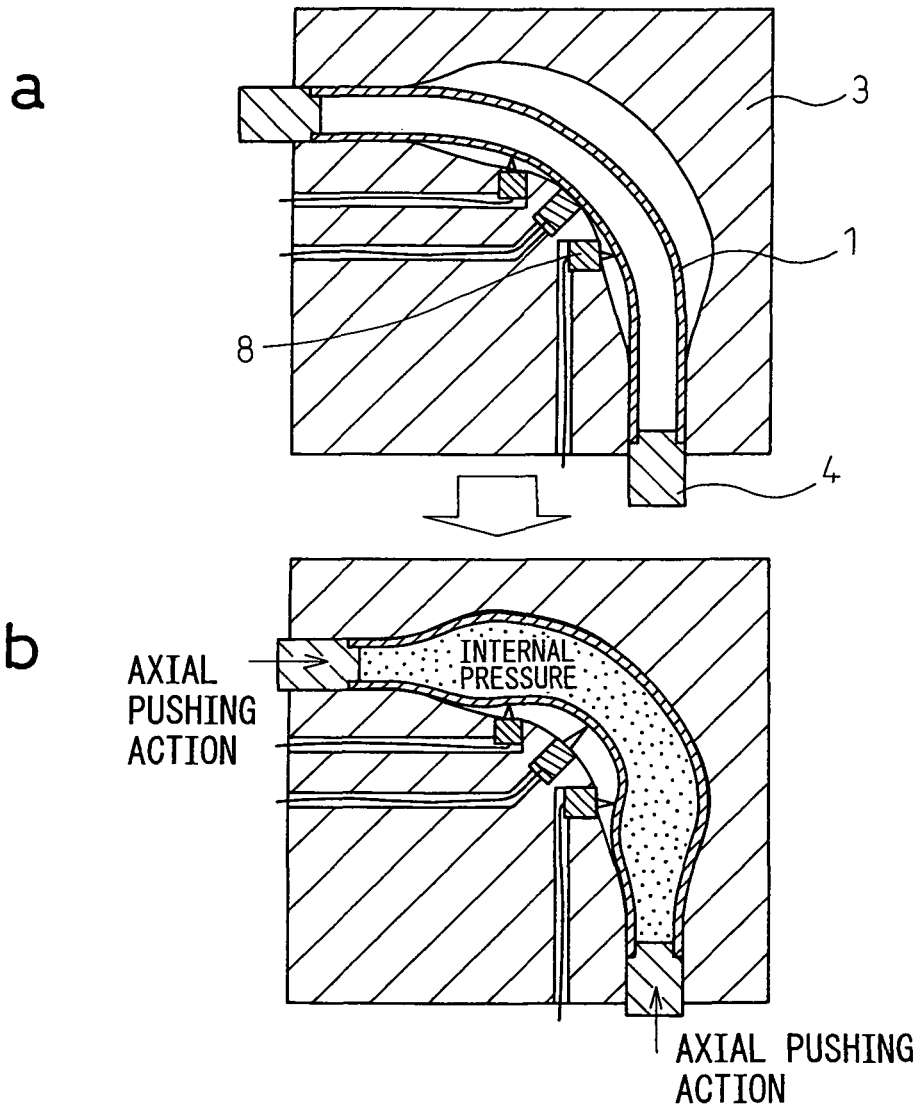
FIG. 4 is an explanatory view of the case where the metal tube initially in contact with the mold loses contact once together with the progress of the hydroforming.

However, as shown in FIG. 4, the metal tube, in the initial state, is set so as to contact the mold, but along with the progress of the hydroforming, sometimes it loses contact once with the mold. In such a case, the sensors should be mounted at such positions losing contact once along with progress.

In the example of FIG. 4, the center position of the inside of the bend of the metal tube 1 bent into a predetermined shape in advance, in the initial state, contacts the mold 3 as shown in FIG. 4*a*, but temporarily loses contact in the middle of the progress of the hydroforming as shown in FIG. 4*b*. In this case, in the initial state, contact sensors are attached to locations before and after the center position inside the bend not contacting the metal tube and a contact sensor is attached at a location facing the center of the inside of the bend of the metal tube 1 contacting the mold in the initial state so as to enable detection of final contact with the mold.

EXAMPLES

Below, examples of the present invention will be shown.

For the tube material, steel pipe of an outside diameter of 63.5 mm, a wall thickness of 2.0 mm, and a length of 700 mm (steel type: JIS standard STKM13B) was used. The material characteristics were a YS of 385 MPa and an r value of 0.9.

Figure 5:
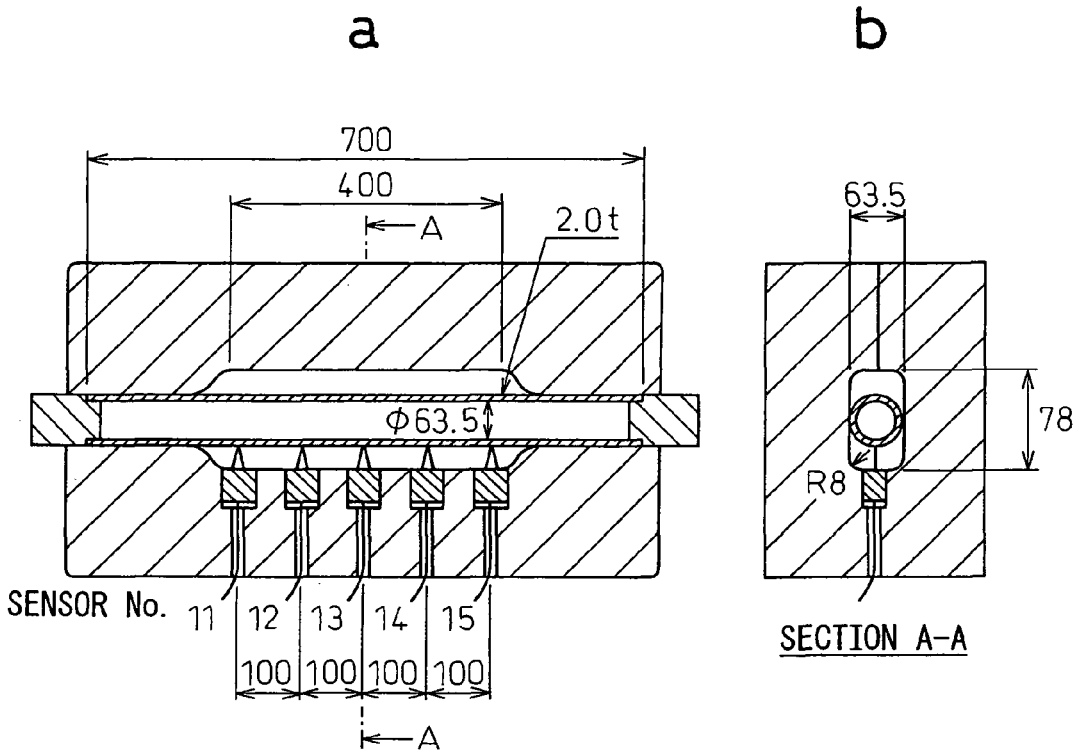
FIG. 5 is an explanatory view of a hydroform mold used in an embodiment of the present invention.

The hydroform mold was shaped expanded into a rectangular cross-section as shown in FIG. 5. For the contact sensors, laser displacement meters were employed. As shown in FIG. 5, they were set at five locations in the tube axial direction.

Further, in the same way as the detailed mounting drawing of FIG. 2, the mating faces of the upper mold 2 and lower mold 3 were cut to form grooves of widths of 88 mm and depths of 18 mm. In these, laser displacement meters 6 were attached. At the locations where the grooves reached the inside of the mold, grooves through which lasers 9 pass are cut into the mating faces of the upper mold 2 and lower mold 3 to depths of 1 mm.

Figure 6:
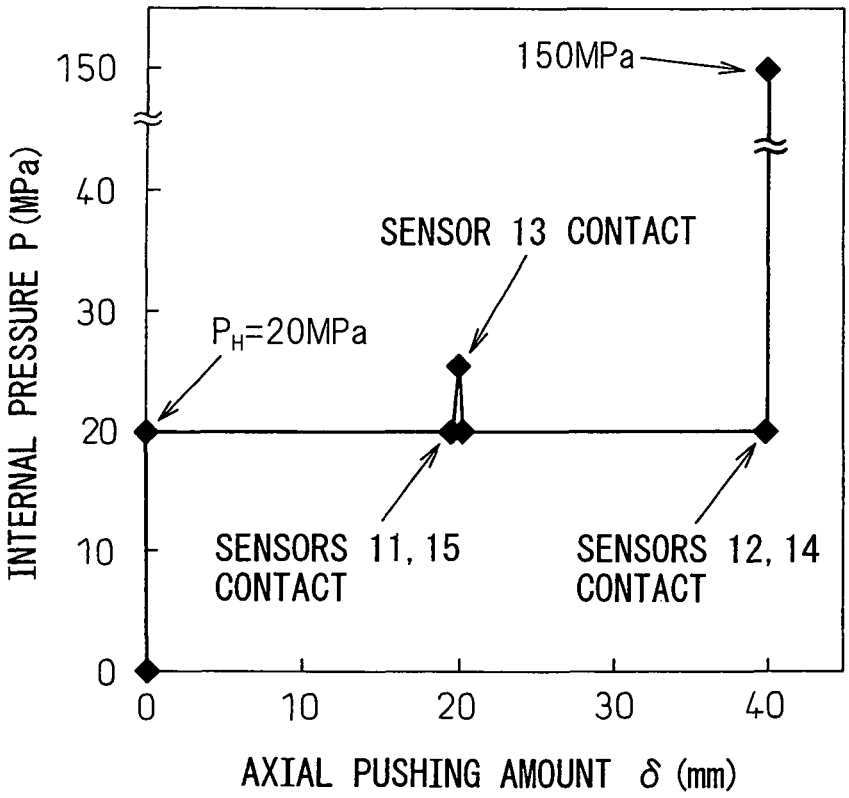
FIG. 6 is an explanatory view of a load path of hydroforming used in an embodiment of the present invention.

The load path of the hydroforming is shown in FIG. 6. First, the initial pressure $P_H$ was determined by the following procedure. If calculating the yield starting pressure $P_p$ in the planar strain state by the above formula (1), it was 28.4 MPa. However, when actually raising the internal pressure until the steel pipe cracked without an axial pushing action, the pipe cracked at 26.5 MPa. Accordingly, the initial pressure $P_H$ was set to 0.76 time the actual cracking pressure of 26.5 MPa, that is, 20 MPa.

Next, the inventors attempted to automatically find the load path using the system of the present invention without determining the conditions of the initial pressure on.

This being the case, as shown in FIG. 6, if applying an axial pushing action by an internal pressure of a constant 20 MPa, the contact sensors 11 and 15 detected contact and the axial pushing action was automatically stopped at an axial pushing amount of 20 mm. After this, while leaving the axial pushing action stopped, only the internal pressure was raised. When the contact sensor 13 detected contact, the increase in pressure was automatically stopped. Note that the pressure at this time was 25.5 MPa. Further, after this, immediately the internal pressure fell to 20 MPa. Next, if applying the axial pushing action while holding the internal pressure at 20 MPa, the contact sensors 12 and 14 detected contact and the axial pushing action was automatically stopped.

Note that the cross-sectional shape in the present embodiment has a small corner roundness of 8 mm, so the final rise in pressure was also automatically applied. This final pressure was set to 150 MPa for working, whereupon the targeted roundness of 8 mm was also achieved, so this value was decided on.

In the above way, the initial pressure and the final increased pressure were found by experiments, but the other parameters of the load path were all automatically found and defect-free hydroformed parts could be automatically worked. Note that the number of experiments when finding the initial pressure and final increased pressure were one each, so the labor involved did not pose that much of a burden. If a simple shape, a general idea can be obtained even by simple calculations.

INDUSTRIAL APPLICABILITY

According to the present invention, finding a suitable load path for hydroforming becomes easy. Due to this, the number of manufacturers performing hydroforming will increase and the number of parts made using hydroforming will also increase. Accordingly, parts will be combined and the weight can be lightened. In particular, application to auto parts will lead to greater reductions in weight of vehicles and therefore improvement of fuel economy and as a result contribute to suppression of global warming. Further, the spread of hydroforming to industrial fields in which not much progress had been made in application in the past, for example, home electric appliance parts, furniture, construction machinery parts, motorcycle parts, building members, etc., can be expected as well.

DESCRIPTION OF NOTATIONS

1 metal tube
2, 3 hydroforming mold
4 axial pushing punch
5 fluid
6 hole (groove) for mounting laser displacement meter
7 hole (groove) for passage of laser
8 and 11 to 15 laser displacement meters
9 laser
10 laser displacement meter cord

The invention claimed is:

1. A hydroforming apparatus comprising
a mold,
an axial pushing means,
an internal pressure means for applying internal pressure to a metal tube set in the mold to form the metal tube into a predetermined shape,
contact sensors configured to sense contact with the metal tube positioned at two or more different positions in the tube axial direction inside said mold at locations not contacting said metal tube when said metal tube is first set in the mold and optionally at locations no longer in contact with the mold during hydroforming, and
a control means for controlling the axial pushing action and the internal pressure by sensing contact of said mold and said metal tube obtained by said contact sensors,
said control means being configured to perform a first step of axially pushing tube ends while holding the internal pressure at a constant value, and stopping the axial pushing when among the contact sensors not yet in contact with said metal tube when the metal tube is first set in the mold, the contact sensors mounted at positions closest to the tube ends sense contact with the metal tube,
a second step of raising only the internal pressure while leaving the positions of the tube ends fixed, and stopping the increase in the internal pressure when at least one of the sensors not yet in contact with the metal tube senses contact, and
a third step of lowering the internal pressure to the constant value of the first step while leaving the positions of the tube ends fixed, and
repeating the first step to third step until all of the contact sensors sense contact.

2. The hydroforming apparatus as set forth in claim 1, wherein said metal tube is bent into a predetermined shape in advance of hydroforming, wherein the contact sensors include contact sensors which are mounted inside said mold at locations facing the inside position of the bend of said metal tube and contact said metal tube when said metal tube is first set in the mold, lose contact with said metal tube once during hydroforming, and finally contact said metal tube again, and wherein the contact sensors include contact sensors which are mounted at least inside said mold at locations facing the inside of the bend before and after said inside position of the bend of said metal tube in the axial direction and which are not in contact with said metal tube when said metal tube is first set in the mold.

3. A method for hydroforming, using an apparatus having a mold, an axial pushing means, and an internal pressure means for applying internal pressure to a metal tube set in said mold to form the metal tube into a predetermined shape, the apparatus including contact sensors provided at two or more different positions in the metal tube axial direction and configured to sense contact with said metal tube inside said mold at locations not contacting said metal tube at the time when said metal tube is first set in the mold and optionally at locations which lose contact with said metal tube during hydroforming, said method comprising performing a first step of axially pushing the tube ends while holding the internal pressure at a constant value, and stopping the axial pushing when contact sensors mounted at positions closest to the tube ends among contact sensors not in contact with the metal tube sense contact with the metal tube, performing a second step of raising only the internal pressure while leaving the positions of the tube ends fixed, and stopping the rise of the internal pressure when at least one of the contact sensors not in contact with the metal tube at the end of the first step senses contact with the metal tube, performing a third step of lowering the internal pressure to the constant value of the first step while leaving the positions of the tube ends fixed, and repeating said first step to third step until all of said contact sensors sense contact with the metal tube.

4. The method for hydroforming as set forth in claim 3, wherein said metal tube is bent into a predetermined pre-hydroforming shape in advance of hydroforming, and wherein said contact sensors include contact sensors which are mounted inside the mold at locations facing the inside position of the bend of said metal tube which contact said metal tube when said metal tube is set into the mold, lose contact with said metal tube once during hydroforming, and finally contact said metal tube again during hydroforming, and wherein said contact sensors include contact sensors which are mounted at least inside the mold at locations facing the inside of the bend before and after said inside position of the bend of said metal tube in the axial direction which are not in contact with said metal tube when said metal tube is set into the mold.

5. The method for hydroforming as set forth in claim 3 or 4 further comprising sensing full contact by the contact sensors, and then further raising only the internal pressure.

* * * * *

UNITED STATES PATENT AND TRADEMARK OFFICE

CERTIFICATE OF CORRECTION

PATENT NO. : 8,621,904 B2
APPLICATION NO. : 12/737320
DATED : January 7, 2014
INVENTOR(S) : Masaaki Mizumura et al.

It is certified that error appears in the above-identified patent and that said Letters Patent is hereby corrected as shown below:

In the Specification

Column 3, line 48, change “metal’tube” to -- metal tube --.

Signed and Sealed this
Twenty-sixth Day of August, 2014

Michelle K. Lee

Michelle K. Lee
*Deputy Director of the United States Patent and Trademark Office*

UNITED STATES PATENT AND TRADEMARK OFFICE

CERTIFICATE OF CORRECTION

PATENT NO. : 8,621,904 B2
APPLICATION NO. : 12/737320
DATED : January 7, 2014
INVENTOR(S) : Mizumura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 452 days.

Signed and Sealed this
Fifteenth Day of March, 2016

Michelle K. Lee

Michelle K. Lee
*Director of the United States Patent and Trademark Office*